United States Patent [19]

Johnson

[11] 4,045,065

[45] Aug. 30, 1977

[54] RELEASABLE DOOR STOP AND STRIKE PLATE ASSEMBLY FOR A BIDIRECTIONAL SWINGING DOOR

[75] Inventor: Larry K. Johnson, Morrison, Ill.

[73] Assignee: Lawrence Brothers, Inc., Sterling, Ill.

[21] Appl. No.: 629,657

[22] Filed: Nov. 6, 1975

[51] Int. Cl.[2] ..... E05C 3/02

[52] U.S. Cl. ..... 292/341.17; 292/341.12

[58] Field of Search ..... 292/341.12, 341.17, 292/304, DIG. 9, DIG. 15, DIG. 65

[56] References Cited

U.S. PATENT DOCUMENTS

| | | | |
|---|---|---|---|
| 984,959 | 2/1911 | Moran | 292/DIG. 15 |
| 1,469,122 | 9/1923 | Strigany | 16/86 A |
| 2,395,788 | 2/1946 | Luxem | 16/86 A X |
| 3,172,168 | 3/1965 | Suska | 49/400 |

*Primary Examiner*—Richard E. Moore

*Attorney, Agent, or Firm*—Olson, Trexler, Wolters, Bushnell & Fosse Ltd.

[57] ABSTRACT

The embodiment of the invention disclosed herein is directed to a door stop assembly for a bidirectional swinging door to permit opening the door in a first direction during normal use and to permit selective opening of the door in a second direction during an emergency. The stop is employed in an assembly which includes a face or strike plate having an opening for receipt of a strike member, a housing formed on one side thereof, all adapted to be set in a mortise of a door frame. The door stop assembly has a depressible body or stop member which preferably, but not necessarily, is of the free floating type which moves linearly inwardly into the housing and then engages the back wall thereof and rocks about a sloping inclined surface of the body portion so that the stop engaging surface of the stop assembly is displaced from engagement with the door, thereby permitting the door to be opened in the opposite direction of its normal use. The stop member includes an adjustably mounted member which may be employed to accommodate wear, misalignment upon initial installation, or warping of the door subsequent to installation.

8 Claims, 5 Drawing Figures

RELEASABLE DOOR STOP AND STRIKE PLATE ASSEMBLY FOR A BIDIRECTIONAL SWINGING DOOR

REFERENCE TO RELATED APPLICATION

The present application is directed to an invention disclosed in Applicant's earlier filed U.S. patent application Ser. No. 472,067, now U.S. Pat. No. 3,946,460, the benefit of which is claimed under 35 USC 120.

BACKGROUND OF THE INVENTION

This invention relates generally to improvements in the structure of stop assembly mechanisms for use with bidirectional swinging doors such as those used in hospitals, and more particularly to a stop assembly mechanism and its combination with a striker plate for a door lock that provides substantial useful improvements over existing stop assemblies which are now commonly used. While the stop assembly of the invention disclosed herein is intended for use primarily in hospitals and other areas where it is desirous to obtain access to rooms, such as wash rooms and the like, during an emergency condition, it will be understood that the stop assembly may be used for other purposes.

Heretofore, stop assembly devices for bidirectional swinging doors have been provided so that doctors and nurses can gain access to wash rooms wherein patients may have collapsed, as shown in U.S. Pat. Nos. 3,172,168 and 2,889,571. Such bidirectional swinging doors have been devised so that actuation of the stop mechanism releases the door so that it can be opened in the opposite direction from its normal use during this emergency condition. The need for such bidirectional operation of doors is readily apparent when considering, for example, elderly patients who may have an attack while in the wash room and collapse against the inside of the door. Therefore, even if the lock mechanism was released, pushing the door open in its normal direction might be precluded and could cause further injury to the patient as the door would push against the patient. Therefore, it is advantageous to pull the door open in the opposite direction.

Door stop assemblies for bidirectional swinging doors as disclosed above generally include a pivotal element which protrudes from the door frame opposite that receiving the door hinges so that the edge of the door engages the stop element. Should access to the wash room or other room be desirous from the outside, a stop element is pivoted into the door frame and the door is then readily opened in the opposite direction. One problem of stop elements which are pivotally mounted to their support units is that actual use of the bidirectional feature of the door is relatively infrequent, and these may freeze or bind before they are ever used. In fact, some bidirectional swinging doors utilizing the stop elements may never be operated during their entire life. Because of the high degree of cleanliness required in hospitals, soap and water washing of the walls, ceilings, and doorways is a relatively frequent occurrence. While the components incorporated in the door stop assembly may be of stainless steel or some other non-rusting metal, they still may corrode or otherwise oxidize. Should the pivot pin rust in position, it would be extremely difficult to depress the stop mechanism into the door frame so that the door can be opened in the opposite direction. As mentioned above, even if the components of the stop mechanism are made of substantially rustproof materials, the pivot pin to which the door stop is secured may stick due to dirt or other gummy substances which may accumulate therein as the result of detergent or soap and water cleaning.

In the above-noted environment, the only abutment surface for the door is that as provided by the stop assembly. In this regard, if the latch receiving strike recess and the stop member are not in proper alignment, the door will rattle, which is obviously an undesired condition. With prior art rescue type stop, wherein the strike plate and stop assembly are separate, misalignment could result quite easily, due to a number of factors. A primary cause for misalignment is human error in the initial installation, however, misalignment may also occur due to wear of the stop member of warping of the door.

The above occurences, which would lead to a loose door, are easily corrected with the present invention. More specifically, the strike plate and stop member are combined as a single unit, so that the relative position of the strike and the door stop can be controlled during manufacture. Further, the abutment surface on the stop member is provided by an adjustably mounted member which can be adjusted toward and away from the latch receiving recess, as needed to correct for wear, misalignment or warping of the door.

SUMMARY OF THE INVENTION

Accordingly, it is an object of this invention to provide a new and improved stop assembly device for bidirectional swinging doors which cannot rust or stick in the stop position, thereby insuring that the stop device will be operable at all times.

Another object of this invention is to provide a new and improved stop assembly for bidirectional swinging doors which has a floating body member forming the stop element which moves linearly inwardly and then rocks about an inclined surface, thereby eliminating the need for pivotal movement or pivot connections or the like.

Still another object of this invention is to provide a door stop assembly for bidirectional swinging doors which includes an opening formed therein to receive the door latch mechanism, thereby providing a striker plate in combination therewith.

A further object of the invention is the provision of a stop assembly, including an adjustable stop surface.

Briefly, the door stop assembly of this invention includes a face plate adapted to be fastened to the doorway frame opposite that carrying the bidirectional hinges for the door. The face plate includes an aperture formed therein and means are provided to secure a housing opposite the aperture to retain a floating member which functions as the stop element. Also formed on the face plate is an opening which receives the door latch mechanism and thereby forming a striker plate for the door. The floating body member is biased outwardly so that oppositely directed flanges formed thereon engage the inner surface of the plate member and prevent the body member from coming out of its housing position. The floating body member is spring-biased and mounted in such a manner so as to allow only linearly inwardly depression or movement initially, until the body member bottoms against an opposite wall of the housing. Once the body member is in this position it is rocked forward so that an inclined surface then engages the wall of the housing completely removing the stop element from position for engagement by the door. The door can then be opened in the opposite direction. Further, as mentioned above, the adjustable stop surface can be used to accommodate misalignment due to wear or warping.

Many other objects, features and advantages of this invention will be more fully realized and understood from the following detailed description when taken in conjunction with the accompanying drawings wherein like reference numerals through the various views of the drawings are intended to designate similar elements or components.

DETAILED DESCRIPTION OF THE ILLUSTRATED EMBODIMENT

Figure 1:
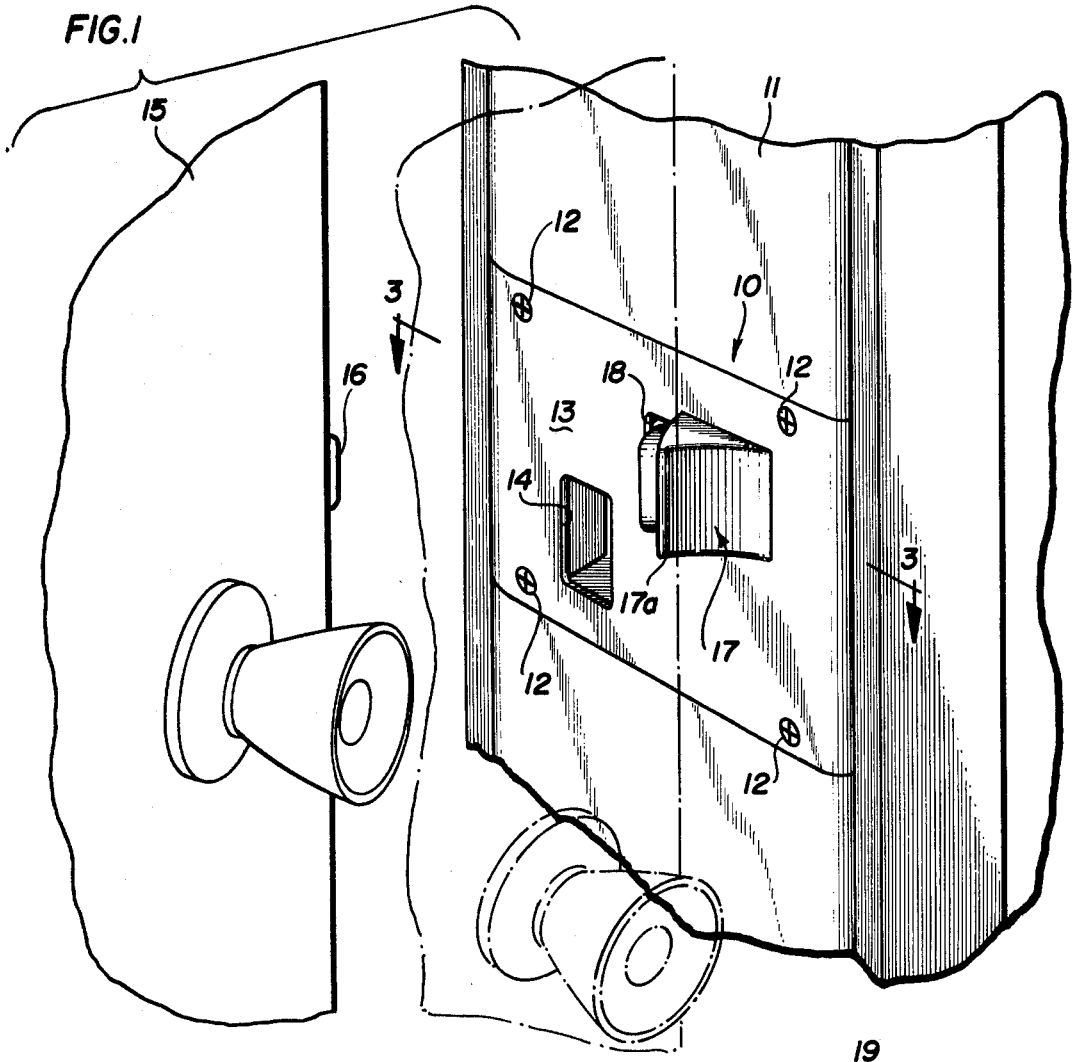
FIG. 1 is a fragmentary perspective view of a door, door frame and stop assembly constructed in accordance with the principles of this invention.

Referring now to FIG. 1, there is seen a door stop assembly constructed in accordance with the principles of this invention and designated generally by reference numeral 10. The door stop assembly 10 is adapted to be fastened to a door frame designated generally by reference numeral 11 by a plurality of screws 12 located near the four corners of a face plate element 13.

Most advantageously, the strike and door stop are fabricated, as a single unit, with the face plate element 13 having a strike recess or opening 14 formed therein to receive a latch mechanism 16 when the door is closed, as seen in phantom lines. Thus, in one installation there is provided an emergency release stop and the strike plate.

Figure 2:
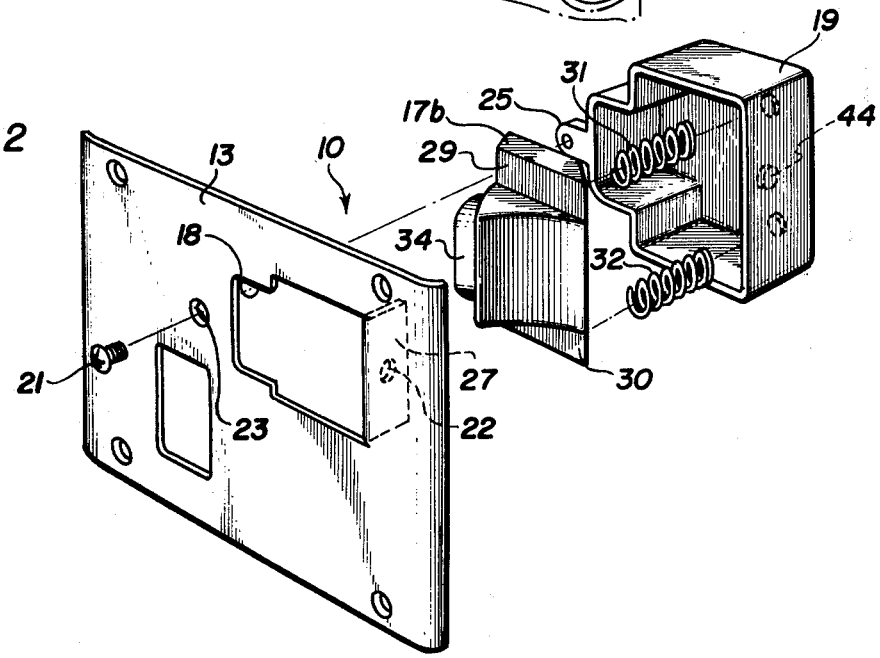
FIG. 2 is an exploded view of the stop assembly constructed in accordance with the principles of this invention.

The stop assembly 10 further includes a floating body or stop member 17 which has a portion thereof 17*a* extending through an aperture 18 formed in the face plate 13 and a second portion 17*b* positioned within a housing 19, as seen in FIG. 2. The floating body member 17 moves freely inwardly within the housing 19 without any type of pivotal mounting.

The housing 19 is secured to the back side of the face plate 13 by one or more screws 20 and 21 passing through openings 22 and 23, respectively, to engage threaded portions 24 and 25, respectively, of the housing 19. In the illustrated embodiment the opening 22 is formed in a struck-out bend-over portion 27 formed of the same material formed on the face plate 13.

The floating body member 17 has diametrically opposed flange portions 29 and 30 formed as part of the second portion 17 to extend beyond the edges of the aperture 18 and engage the rear surface of the face plate 13. These flange members maintain the floating body member within the housing 19. To provide outward bias of the floating body member 19 a pair of coil springs 31 and 32 are positioned within the housing and engage recesses within the movable body member 17 and protuberances within the housing 19. The recesses and protuberances maintain the spring members 31 and 32 in their desired position while allowing free movement of the floating body member inwardly within the housing.

Figure 3:
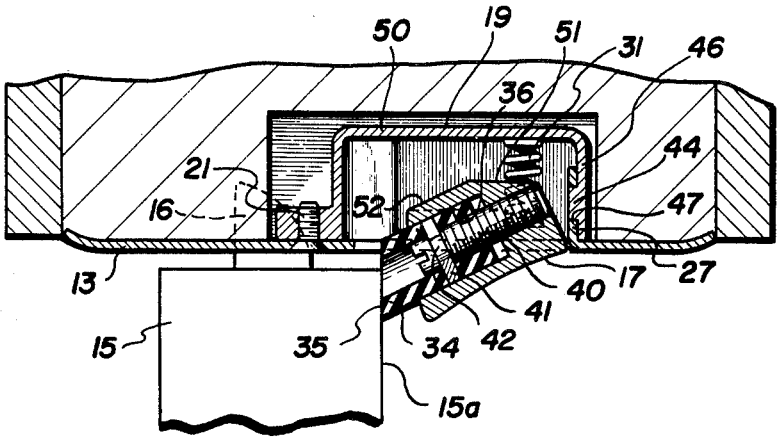
FIG. 3 is a top sectional view of the stop assembly of this invention as taken along line 3—3 of FIG. 1.

Most advantageously, an adjustable resilient stop element 34 is threadedly adjustably secured to the portion 17*b* and angled outwardly therefrom to provide a flat parallel stop surface against which the door engages. This is best seen in FIG. 3. The stop element 34 has a front face 35 formed on a bias, so as to engage the door in flush, face-to-face, engagement. The purpose for this will become apparent from the preceding description.

FIG. 3 illustrates the door stop assembly of this invention in its normal position having the stop bumper element 34 with the front face 35 thereof engaging the surface 15*a* of the door 15. As can also be seen in FIG. 3, the stop element 34 is received in a recess 36 in the floating body member 17 and is attached thereto by a screw element 40 threadedly engaged therewith. A retainer ring 41 is carried by the stop element 34 and is engaged in a groove 42 formed adjacent the head of the screw 40, thus fixing the relative position of screw 40 and stop element 34. Operation of the screw 40 will thus produce movement of the stop 34 inwardly or outwardly of the recess 36, permitting adjustment of the relative position of said stop.

The above-mentioned adjustment is advantageous from a number of standpoints. First, should the element 34 become worn, it can be moved outwardly to maintain engagement with the door surface 15*a*. Where no adjustment is provided, the stop may become worn in service and result in rattling of the door. Secondly, this adjustable feature aids in the initial installation. In this regard, it is not necessary that precise positioning of the stop device be effected initially, as the position of the bumper 34 can be adjusted to accommodate variances occuring as a result of improper installation, or warping of the door in service. With the strike or face plate 13 being formed as an integral part of the overall assembly 10, it is possible to control the relative positioning of the stop or body member 17 and the opening 14, further reducing the charge of misalignment. Also, as is believed readily apparent, installation of the single, combined stop and strike plate unit 10, is much easier and takes less time than separate assembly of a strike plate and stop, as was necessitated by prior art designs.

It will be recalled that the stop element 34 is provided with a flat surface 35 engaged against the door surface 15*a* in flush, face-to-face engagement. As such, in the position illustrated in FIG. 3, the floating member 17 can only move linearly inward of the aperture 18 due to this flush engagement of the stop element 34 with the door.

Also seen in FIG. 3 is an alternate form of fastening the housing portion 19 to the face plate 13. In this instance a protuberance 44 is provided on a side wall 46 of the housing 19, which protuberance engages an aperture 47 formed in the struck-out bend-over portion 27.

Figure 4:
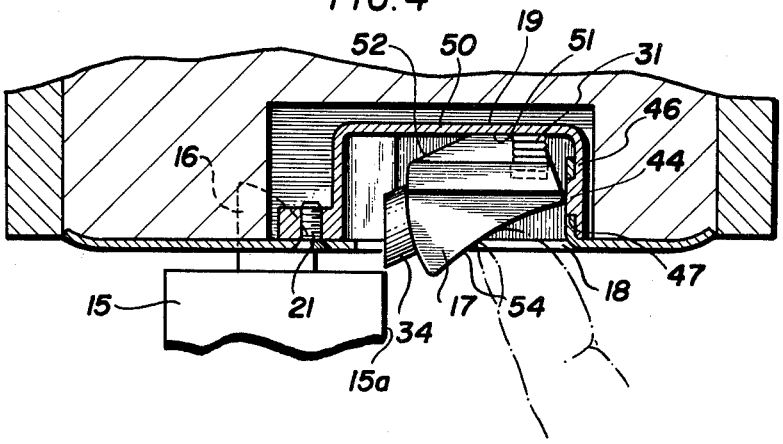
FIG. 4 is a top sectional view similar to that of FIG. 3 and shows the initial linear inward movement of the floating body member forming the stop element.

The housing 19 has a back wall 50 thereof positioned a predetermined distance behind the aperture 18 through which the floating body member 17 extends. When it is desirous to open the door 15 in the opposite direction from its normal use, the floating body member 17 is pressed inwardly into the housing 19 until the flat surface 51 thereof engages the wall 50. This initial movement will produce the condition as illustrated in FIG. 4. As mentioned above, due to the flush engagement of the stop surface 35 with the door only linear movement is possible upon depression of the floating body 17 to the position of FIG. 4. When the surface 51 bottoms on wall 50, all or the major portion of stop element 34 is disengaged from the door surface 15*a,* as seen in FIG. 4. Even if a slight degree of engagement remains as seen in FIG. 4, the portion of stop element 34 still engaged with the door is quite flexible and will permit operations as discussed hereinafter.

Figure 5:
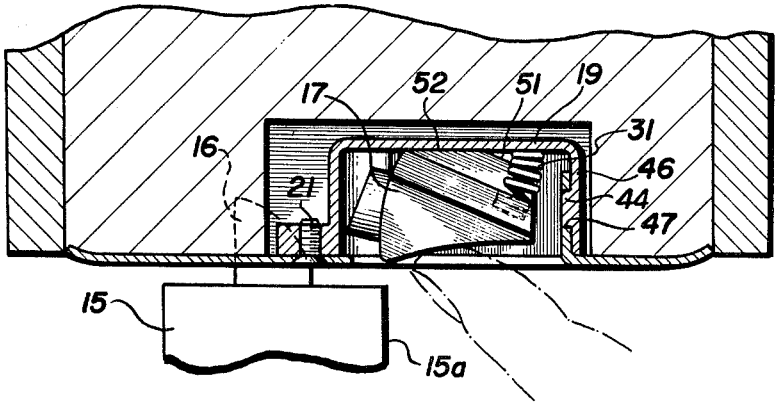
FIG. 5 is a top sectional view similar to that of FIG. 4 illustrating the floating body member rocked about an inclined surface formed thereon.

Once the body member 17 is seated on the wall 50, the entire element 17 is rocked forward, as shown in FIG. 5. This movement will bring the inclined surface 52 into engagement with wall 50 while depressing the remainder of the body 17 interiorly of the aperture 18. When the above occurs, the door 15 may be opened in the aforesaid opposite direction and safely operated.

With further reference to FIG. 5, when the stop element is rocked forward to engage surface 52 with the wall 50, the tapered surface 54 on the stop is brought to a generally flush position relative to plate 13. Accordingly, during opening of door 15 in said opposite direction, there is no danger that the operator's finger will become pinched between the door edge and the edge of opening 18.

Further, once the emergency is over, resetting of the door 15 is quite easy. As the door swings back to its original position it will engage aforementioned tapered surface 54. This engagement will produce the operation essentially as shown in FIGS. 4 and 5, in that the body 17 will move inwardly and then will rock to permit the door to pass the stop and arrive at its original position.

Thus, it is believed clear that there is provided an emergency release stop which is not subject to becoming inoperative or stuck during long periods of non-use, yet this device of the present invention provides a safe, reliable stop that can be easily operated.

While a single specific embodiment of the invention has been disclosed herein, it will be understood that variations and modifications may be effected without departing from the spirit and scope of the novel concepts as defined in the following claims.

The invention is claimed as follows:

1. A door stop assembly for a bidirectional swinging door to permit opening of a door in a first direction during normal use and to permit selective opening of the door in a second direction during an emergency, comprising in combination: a face plate adapted to be fastened to a doorway frame and having a first aperture formed therein to receive the latch element of the door to provide a striker aperture therefore, a second aperture formed in said plate and offset laterally of said first latch receiving aperture, housing means secured to said face plate in registry with said second aperture for insertion into a mortise formed in the doorway frame receiving the same, a depressible stop member movably positioned within said housing means, said stop member including a main body element having a portion thereof projecting from said plate through said second aperture, and a bumper element carried by said portion of the main body element and having an abutment surface facing said first aperture for engagement by a door to provide the stop for said door, and means mounting said bumper element to said main body portion for movement toward or away from said first aperture, including means for maintaining a selective position, whereby the position of said stop relative to said strike may be adjusted and maintained to keep said door firmly engaged against said stop when in the closed condition with the door latch engaged in said first aperture.

2. An emergency release type door stop assembly for use with a bidirectional swinging door of the type including a latch means engagable with cooperating means on a door frame or the like, said assembly upon operation thereof permitting selective opening of the door in a direction opposite to that normally employed, said stop assembly comprising in combination: a face plate adapted for attachment to a doorway frame, said face plate having an aperture therein; stop means depressibly mounted relative to said aperture for movement between a first position wherein said stop means extends from said face plate for movement limiting engagement with said door, and a second position wherein said stop means is disposed inwardly of said face plate to permit movement of said door in said opposite direction; said stop means including a main body element and a resilient bumper element having an abutment surface for engagement by said door, mounting means for affixing said bumper to said main body element, and comprising a threaded member carried by said bumper element and engagable with cooperating thread means on said main body element, means mounting said threaded member to said bumper element for relative rotation with respect thereto, while maintaining the relative longitudinal positional relationship of said threaded member with respect to said bumper element, such that upon rotation of said threaded member, both said threaded member and said bumper element will move longitudinally relative to said main body element whereby the position of said abutment surface can be selected and maintained to insure firm rattle-free contact of said door with said stop means upon engagement of said latch means.

3. A door stop assembly according to claim 2, wherein said threaded member carried by said bumper element is externally threaded.

4. A door stop assembly according to claim 2, wherein said means mounting said threaded member to said bumper element includes a ring fixed with respect to said bumper element, and a groove formed in said threaded member in which the inner peripheral surface of said ring is disposed, thereby rendering said threaded member captive with respect to said bumper element, with the relative dimensions of said ring and said groove being such that said threaded member can be rotated with respect thereto.

5. A door stop assembly according to claim 2, wherein said threaded member includes means for engagement by a drive tool, which means is disposed below said abutment surface of said bumper element, said bumper element including an access opening permitting engagement of a drive tool with said threaded member.

6. A door stop assembly according to claim 2, wherein said face plate includes a second aperture laterally offset with respect to said aperture in which said stop means is disposed, said second aperture providing cooperating means for said latch means.

7. An emergency release type of door stop assembly for use with a bidirectional swinging door of the type including latch means engageable with cooperating means on a door frame or the like, said stop assembly upon operation thereof permitting selective opening of the door in a direction opposite to that normally employed, said stop assembly comprising in combination: a face plate adapted for attachment to a doorway frame, said face plate having an aperture therein, stop means depressibly mounted relative to said aperture for movement between a first position wherein said stop means extends from said face plate for movement limiting engagement with said door, and a second position wherein said stop means is disposed inwardly of said face plate to permit movement of said door in said opposite direction, said stop means including a main body element and a resilient bumper element having an abutment surface for engagement with said door, mounting means for attaching said bumper element to said main body element, said mounting means including, a relatively smooth recess formed in said main body element, with a first portion of said bumper element slidably disposed in said recess for relative movement, and a second portion of said bumper element, including said abutment surface extending from said main body element, and a separate adjustment member engaged with said bumper element and said main body element, said adjustment member formed so that rotation thereof will produce movement of said bumper element with respect to said recess, to attain and maintain a desired position for said bumper element relative to said main body element such that the relative position of said abutment surface with respect to the cooperating means on the door frame may be adjusted and maintained upon repeated engagement of said abutment surface by said door, to insure that the door will be in firm, rattle-free contact with said stop means upon engagement of said latch means.

8. A door stop assembly according to claim 1, wherein said means mounting the bumper element to said main body portion includes a threaded member carried by said bumper element for engagement with corresponding threaded means on said main body portion, and an opening formed in the abutment face of said bumper element providing access for the engagement of a tool with said threaded member, and means mounting said threaded member to said bumper for relative rotation with respect thereto, while maintaining the relative longitudinal relationship of said threaded member and said bumper element, such that rotation of said threaded member will produce movement of said bumper relative to said main body portion.

* * * * *